US005170557A

United States Patent [19]

Rigsby

[11] Patent Number: 5,170,557

[45] Date of Patent: Dec. 15, 1992

[54] METHOD OF FORMING A DOUBLE WALL, AIR GAP EXHAUST DUCT COMPONENT

[75] Inventor: Donald R. Rigsby, Jenison, Mich.

[73] Assignee: Benteler Industries, Inc., Grand Rapids, Mich.

[21] Appl. No.: 694,458

[22] Filed: May 1, 1991

[51] Int. Cl.[5] ..... B23D 39/00

[52] U.S. Cl. ..... 29/890.08; 29/455.1; 29/512; 72/61; 72/368; 138/148

[58] Field of Search ..... 29/455.1, 512, 890.032, 29/890.036, 890.053, 890.08, 890.14; 72/61, 62, 367, 368; 264/319, 320, 325, 512, 563, 564

[56] References Cited

U.S. PATENT DOCUMENTS

| | | | |
|---|---|---|---|
| 464,737 | 12/1891 | Stapley . | |
| 1,764,561 | 6/1930 | Gulick . | |
| 2,652,121 | 9/1953 | Kearns, Jr. et al. | 170/159 |
| 2,713,314 | 7/1955 | Leuthesser, Jr. | 113/44 |
| 2,718,048 | 9/1955 | Sedgwick | 29/463 |
| 2,734,473 | 2/1956 | Reynolds | 113/44 |
| 2,837,810 | 6/1958 | Ekholm | 29/157 |
| 3,002,269 | 10/1961 | Hopkins | 29/441 |
| 3,133,612 | 5/1964 | Sailler | 181/36 |
| 3,173,196 | 3/1965 | Grimm | 29/157 |
| 3,196,905 | 7/1965 | Hills | 138/148 |
| 3,201,861 | 8/1965 | Fromson et al. | 29/455 |
| 3,206,836 | 9/1965 | Schlussler | 29/157 |
| 3,209,787 | 10/1965 | Brown et al. | 138/114 |
| 3,292,731 | 12/1966 | Ballard | 181/36 |
| 3,324,533 | 6/1967 | Watteau | 29/156 |
| 3,404,445 | 10/1968 | Crouse | 29/157 |
| 3,443,409 | 5/1969 | Matsukin | 72/56 |
| 3,722,221 | 3/1973 | Chopin et al. | 60/282 |
| 3,786,791 | 1/1974 | Richardson | 123/65 |
| 4,022,019 | 5/1977 | Garcea | 60/282 |
| 4,142,366 | 3/1979 | Tanahashi et al. | 60/322 |
| 4,185,463 | 1/1980 | Tanahashi et al. | 60/322 |
| 4,207,660 | 6/1980 | Rao et al. | 29/156 |
| 4,285,109 | 8/1981 | Lautzer et al. | 29/157 |
| 4,332,073 | 6/1982 | Yoshida et al. | 29/421 |
| 4,404,992 | 9/1983 | Sasaki et al. | 138/140 |
| 4,410,013 | 10/1983 | Sasaki et al. | 138/149 |
| 4,413,657 | 11/1983 | Sasaki et al. | 138/149 |
| 4,513,598 | 4/1985 | Costabile | 72/62 |
| 4,567,743 | 2/1986 | Cudini | 72/61 |
| 4,619,292 | 10/1986 | Harwood | 138/113 |
| 4,656,712 | 4/1987 | Harwood et al. | 29/157 |
| 4,656,713 | 4/1987 | Rosa et al. | 29/157 |
| 4,711,088 | 12/1987 | Berchem et al. | 60/321 |
| 4,744,237 | 5/1988 | Cudini | 72/367 |
| 4,759,111 | 7/1988 | Cudini | 29/523 |
| 4,829,803 | 5/1989 | Cudini | 72/367 |
| 5,100,047 | 3/1992 | Nakagawa et al. | 29/898.08 X |

FOREIGN PATENT DOCUMENTS

| | | |
|---|---|---|
| 229114 | 2/1909 | Fed. Rep. of Germany . |
| 2305377 | 8/1974 | Fed. Rep. of Germany . |
| 2337479 | 2/1975 | Fed. Rep. of Germany . |
| 130464 | 10/1979 | Japan . |
| 122632 | 9/1980 | Japan . |
| 046831 | 3/1985 | Japan . |
| 63-215809A | 9/1988 | Japan . |
| 1404667 | 6/1983 | U.S.S.R. . |
| 2091341 | 1/1981 | United Kingdom . |

*Primary Examiner*—Mark Rosenbaum
*Assistant Examiner*—S. Thomas Hughes
*Attorney, Agent, or Firm*—Price, Heneveld, Cooper, DeWitt & Litton

[57] ABSTRACT

A method of forming a tubular, double wall, air gap, exhaust duct component for an internal combustion engine, the resulting exhaust duct component, and the blank for such, involving providing an inner membrane duct element, with orifices therethrough spaced along its length, providing an outer structural duct element in 360 degree engagement with the inner duct element in the areas where forming and bending operations are to be performed, conducting such forming and bending operations, securing the resulting blank in a hydroforming die cavity, sealing the ends of the inner element to the ends of the outer element, plugging the ends of the inner element, injecting a liquid, preferably water, into the inner duct element and increasing the pressure on the liquid to expand the outer element away from the inner element and ultimately into conformity with the die cavity while the inner element floats in place, in a manner to create an air gap substantially over the full length of the duct component, i.e., except at the ends.

12 Claims, 3 Drawing Sheets

METHOD OF FORMING A DOUBLE WALL, AIR GAP EXHAUST DUCT COMPONENT

BACKGROUND OF THE INVENTION

This invention relates to dual wall, air gap, engine exhaust duct components, a blank therefor, and a method of making such.

When exhaust gases of an internal combustion engine are conducted through the ducts of the metal exhaust manifold and connected exhaust ducts such as a cross-over pipe, to the catalytic converter, it is desirable to lose minimal heat from the gases upstream of the catalytic converter. This keeps them as hot as possible for the quickest "light off" in the catalytic converter, to minimize unwanted emissions. It also minimizes temperature rise in the engine compartment. It is recognized in the industry that the use of a double wall construction with an air gap therebetween over most of the length thereof is advantageous for achieving lower heat transfer. This type of technology is generally shown and/or described, for example, in U.S. Pat. Nos. 4,619,292; 4,185,463 and 4,022,019. Known methods for the manufacture of dual wall, air gap, exhaust gas, duct components are complex and costly, however, with varying techniques having been proposed, such as splitting the outer tube and welding the split outer pipe components around the inner tube as in U.S. Pat. Nos. 4,619,292; 4,656,712 and 4,501,302; or welding an assembly around the inner tube as in U.S. Pat. No. 4,142,366.

Another known method used commercially for making exhaust system components with air gap characteristics utilizes the technique of placing one tube inside another tube while leaving the desired air gap, then bending and forming them to the desired overall shape with a medium such as sand, lead, shot, ice, or the like placed between the outer tube and the inner tube in an effort to control the gap between the two during the bending and forming operations. Unfortunately, most media inserted in this fashion do not react to bending and forming forces in the same way that the metal in the tubes would. It is also very difficult to control the hoped-for gap between the two components when bending and forming. Exhaust duct components are often of peculiar configuration and complex in nature, with enlargements or protrusions in some areas, recesses in other area to accommodate the engine compartment, etc., bends along their length to extend in the desired direction, and the like. Attempting to provide a dual wall structure with the desired air gap for these complexly configurated components of the exhaust system presents significant practical and economical difficulties.

SUMMARY OF THE INVENTION

The present invention comprises a novel process of forming a dual wall, air gap, engine exhaust-gas conducting component, a novel blank which can be formed into the component, and the resulting novel exhaust duct component itself. The novel method employs hydroforming steps preferably using water as the forming liquid. The technique of hydroforming tubular elements to create a desired final shape is known, as represented, for example, in U.S. Pat. Nos. 3,443,409; 4,285,109; 4,332,073; 4,513,598; 2,837,810; 2,718,048; 2,734,473; and 2,713,314. Hydroforming of vehicle frame components with less than 5 percent expansion is set forth in U.S. Pat. Nos. 4,567,743; 4,744,237, 4,759,111 and 4,829,803. Pressure forming of tubes which have inner and outer tubes in engagement with each other by first extruding the walls, flattening the extrusion, and pressure expanding the inner tube and the outer tube is taught in U.S. Pat. Nos. 3,201,861 and 3,173,196.

However, hydroforming of dual wall air gap exhaust duct components as taught herein is not known to have existed or to have been accomplished heretofore.

The exhaust system component formed according to this invention is from a blank having an inner membrane tube, an outer structural tube in full engagement with the inner tube, the inner tube having an initial thickness, size and periphery approximately that desired for its final thickness, size and periphery, and the outer tube having an initial size substantially smaller than the final desired size, an initial thickness considerably greater than its final thickness, and having an initial simple configuration formed into a complex configuration. The outer structural tube is imperforate. The inner membrane tube has a multiple of spaced apertures therethrough along its length. These apertures can be machined or pierced through the inner element while in a flat configuration, or can be machined or pierced through it while in its tubular configuration, before the two elements are interfitted. The outer element has inner diameter portions generally matching the corresponding outer diameter portions of the inner tube. The tubes can be interfitted as with a ram to form a blank for the succeeding process steps. When in this blank form, the outer tube is caused to have full 360 degree contact with the inner tube so that any prebending and/or preforming steps to be performed prior to hydrodynamically expanding the device to the ultimate final desired configuration, does not result in wrinkling or like deformation of the elements, or undue flattening of the outer tube.

The inner membrane tube has a thin wall to facilitate minimal heat absorption with as little heat loss from the gases as possible. The outer structural tube has an initial thickness at least equal to and normally greater than that of the inner tube. This initial outer tube thickness is determined by the gap required in the final product which in turn dictates the elongation the section must go through and the ultimate desired wall thickness after forming. This outer element provides structural strength to the assembly, closes off the conduit to the outside atmosphere, and protects the inner membrane member. The combination blank of the inner membrane tube and the outer structural component is then preformed and bent, if and as required, in conventional forming and bending apparatus. Subsequently the blank is secured in the cavity of a hydroforming die which is closed for the next step of the operation. The assembled blank is secured in the die having an internal cavity of the desired final configuration and size for the outer tubular element, the ends of the two elements being sealed together. This closes off the ends of the outer tube, the ends of the inner tube being plugged with inserted mandrels.

The location of the center line and the periphery of the assembled element relative to the center line of the die cavity is selected to determine location of the inner membrane element relative to that of the outer element in the final product. Hydraulic fluid, preferably water, is injected, as through one of the mandrels, to fill the inner tube cavity, and thence forced through the inner tube apertures to contact the inner surface of the outer tube. Tremendous pressure is applied via the fluid, forcing the outer tube to expand outwardly away from the inner tube and into conformity with the die cavity walls, while the inner membrane tube floats statically in position between its ends. The pressure applied to the hydraulic fluid results in it flowing through the apertures and applying pressure uniformly against the outer member, expanding portions of the outer member successively in increasing amounts until its final configuration conforms exactly to that of the die cavity. Following a short period of time for the material in the outer tube to set into its final shape, the pressure is released and the hydraulic fluid drained out. Any undesired offal on the ends of the component may be removed.

The resulting exhaust duct product has the desired configuration, the desired location of the inner tube relative to the outer tube, and a corresponding air gap over the length of the duct. This gap can vary in width from a few thousandths of an inch to one-half inch or so between portions of the inner tube and the outer specially configurated element. It has excellent characteristics for absorbing minimal heat from the exhaust gases so as to maintain high exhaust gas temperatures and lower engine compartment temperature.

These and other features, advantages and objects of this invention will be apparent upon studying the following detailed description in conjunction with the drawings.

DESCRIPTION OF THE PREFERRED EMBODIMENT

Referring now specifically to the drawings, the structure 10 produced in accordance with this invention is shown to be a crossover exhaust pipe or duct to be attached to the exhaust manifold of an internal combustion engine, to conduct the hot exhaust gases from one exhaust manifold to the other exhaust manifold components which discharges into the catalytic converter where chemical reaction takes place to convert noxious gases for achieving reduced emissions The exhaust duct component may alternatively be other than a crossover, e.g., part or all of the main body or "log" of the exhaust manifold, an exhaust pipe, etc. As noted previously, the use of dual wall tubing with an air gap between the two walls is known to be advantageous for such exhaust duct components for at least three reasons. Firstly, the amount of heat absorbed by the duct from the hot exhaust gases prior to their entry into the catalytic converter is lessened, so that the gases are at higher temperatures when entering the converter for rapid light off of the converter and increased chemical conversion of the gaseous products. Another significant reason is lower engine compartment temperature. Still another reason is because the dual wall with the air gap between them considerably lessens the noise resulting from the system.

The present invention provides technology for creating a dual wall, air gap, exhaust duct economically, with selected, minimum inner membrane tube thickness, adequate outer structural tube thickness, and an air gap which extends substantially the full length of the duct.

Figure 1:
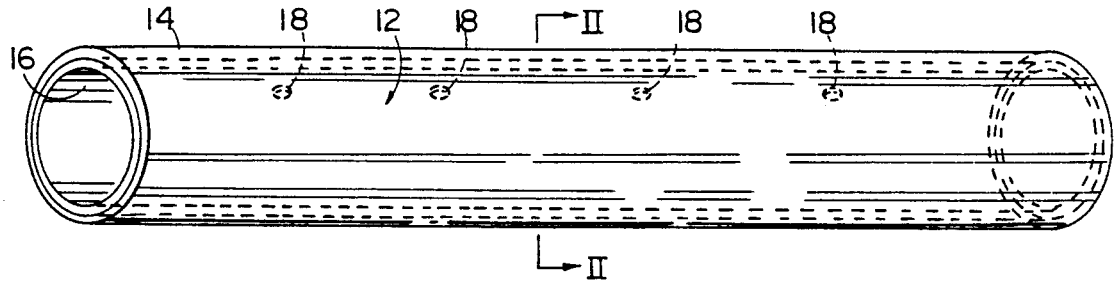
FIG. 1 is an elevational view of a cylindrical tubular blank in accordance with this invention.
Figure 2:
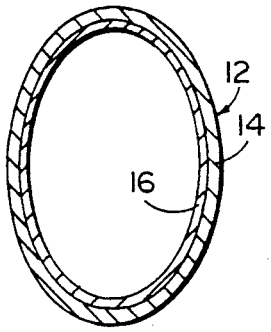
FIG. 2 is a sectional view of the blank in FIG. 1, taken on plane II—II.
Figure 6:
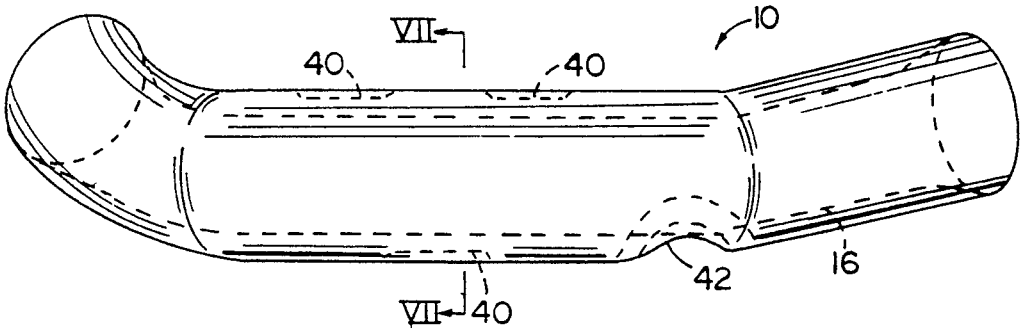
FIG. 6 is an elevational view of the product matter of FIG. 4, after hydroforming.

Referring particularly to the drawings, the illustrated exhaust gas duct product 10 (FIG. 6) formed according to this technology has an initial configuration basically cylindrical in nature as shown at 12 (FIG. 1), it being realized that the word cylindrical does not necessarily require a circular cross section. The cross section is more typically oval, as shown for example in FIG. 2. This blank 12 is formed of two metal elements, which may be two types of materials but preferably stainless steel, forming an outer structural duct element 14 and an inner membrane duct element 16. Outer duct element 14 provides structural strength to the assembly and protects the inner membrane element 16. The inner membrane element is formed as thin as possible, having a wall thickness of about 0.028 inch or less. The outer element has a wall thickness of approximately 0.020 inch or greater, but in each instance equal to or greater than that of the inner wall thickness. A typical inner wall thickness would be 0.020 to 0.028 inch, while a typical outer wall thickness would be about 0.024 to 0.065 inch, but at least equal to and preferably greater than said inner wall thickness. Inner element 16 has a plurality of orifices extending through the wall thereof, such having a size of about 0.125 inch. These are located over its length and preferably positioned along a neutral axis zone to whatever bending and forming is required. That is, when the blank is bent in a particular direction causing compression of the metal on one side and stretching on the opposite side, the row of orifices should be about 90 degrees removed from these sides. Further, if the tube is formed with a welded seam, the seam is also preferably placed on a neutral axis zone, either alongside the row of orifices or opposite thereto. The number and size of these orifices should be limited so as not to cause significant turbulence of flowing exhaust gases from the engine in the final product. These orifices can be formed by machining, e.g., drilling, by a piercing die or the equivalent, preferably while the material is still flat, i.e., prior to its being formed into a tubular configuration. However, the apertures could be formed into element 16 after it is in a tubular configuration. Normally such apertures will be formed prior to combination of elements 14 and 16 due to practicality.

Figure 3:
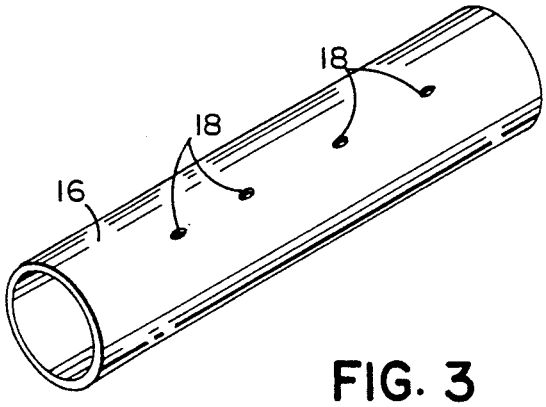
FIG. 3 is a perspective view of the inner membrane tubular element in the blank of FIGS. 1 and 2.
Figure 4:
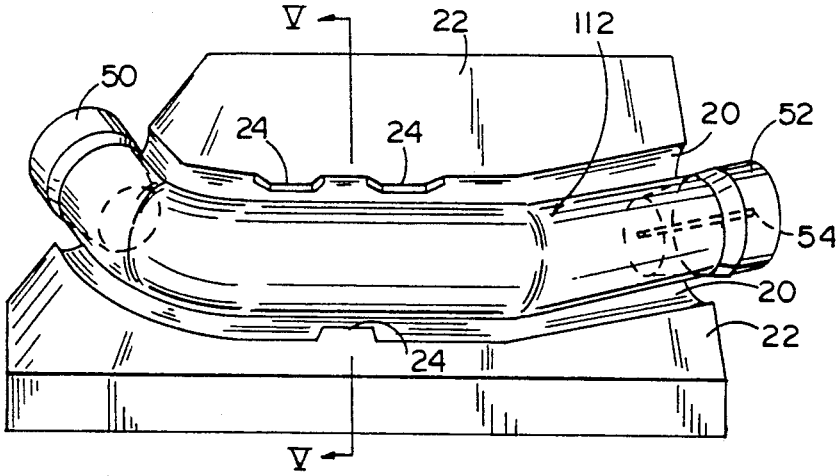
FIG. 4 is an elevational view of the blank of FIGS. 1 and 2, bent and formed to a particular angular arrangement, and placed in the die cavity of a die assembly.
Figure 5:
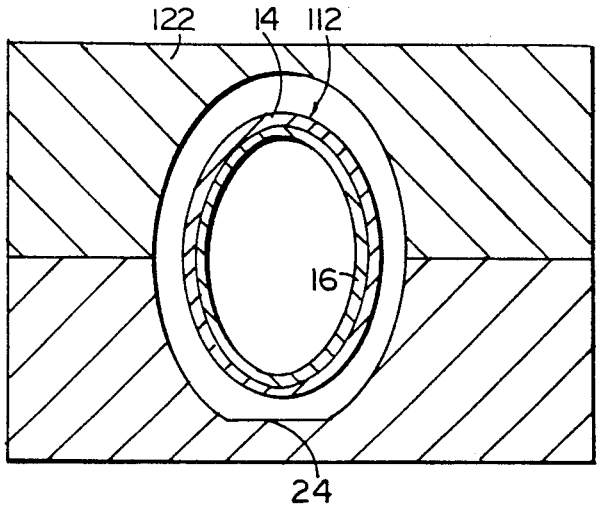
FIG. 5 is a sectional view taken on plane V—V of FIG. 4, but showing both parts of the die assembly.
Figure 9:
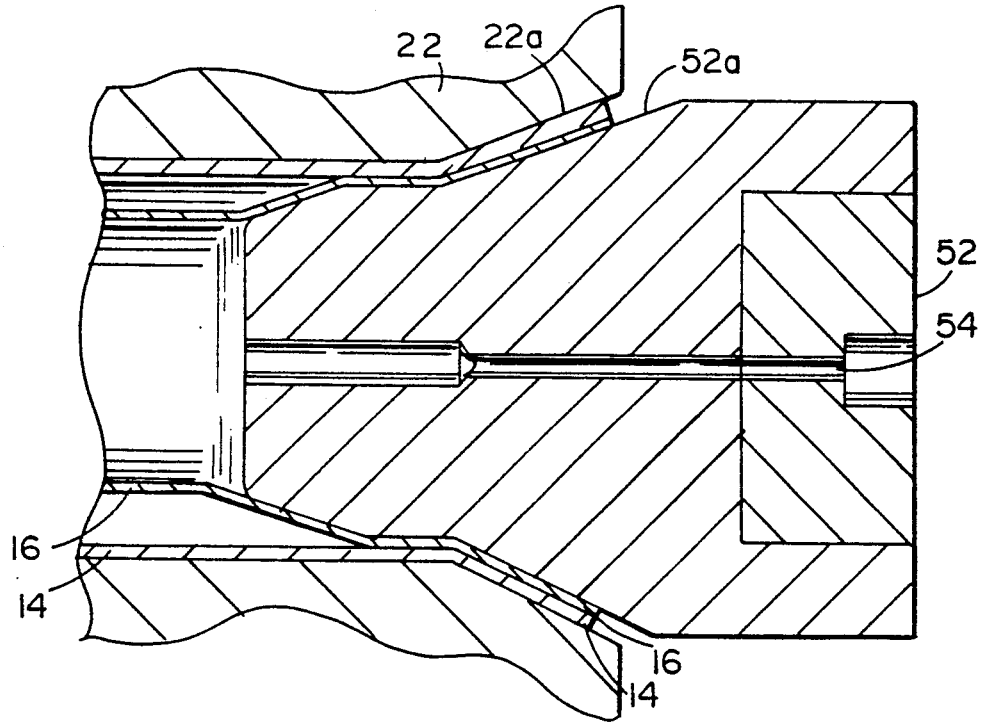
FIG. 9 is a fragmentary, enlarged sectional view of the other end of the hydroforming die and the blank therein.

These two elements 14 and 16 then can be rolled into their mutually contacting tubular form, typically cylindrical, either simultaneously or separately. If formed separately, they are then interfitted, i.e., the inner tube is inserted into the outer tube by ramming or pulling, so as to put the tubes into engagement with each other over their length. Normally the two elements will have the same length, with their ends coincident to each other, and with the outer diameter of inner element 16 (FIG. 3) being generally equal to the inner diameter of outer element 14 so that the surfaces are in 360 degree contact over the length of the elements, and at least in those areas which are to be subjected to preforming and/or bending operations prior to the hydroforming step. These performing operations to modify the surface of portions of the outer element, and/or bending operations to achieve the desired angular relationship between longitudinal segments of the blank, may be performed utilizing conventional forming and bending dies (not shown). The ends of the component can be formed to an enlarged diameter to create telescopic sleeves by using the mandrels 50 and 52 as shown in FIGS. 8 and 9. The preformed blank such as that shown at 112 in FIG. 4 is illustrated placed within the cavity 20 of a die assembly, one part 22 of which is depicted herein in FIG. 4, and both parts 22 and 23 depicted in FIGS. 5 and 7. The cooperative die components complement each other, both being securely held in fixed position in a press or the equivalent to prevent the die components from separating under tremendous applied internal pressures.

Die cavity 20 has a configuration and surface characteristics exactly matching those desired in the exterior of the final product. As can be noted from FIG. 4., the diameter of the die cavity is usually significantly greater than that of the blank 112 placed therein, although overall orientation of the longitudinal segments of the cavity generally match the orientation of the segments of the blank positioned in the cavity. The die cavity is also shown to include any protrusions 24 to cause correspondingly shaped recesses or flats 40 within the final product as for attachment of heat shield brackets of conventional type (not shown), and any protrusions to form depression 42 (FIG. 6) or the like to interfit with other engine components (not shown) as necessary in the engine compartment.

Figure 7:
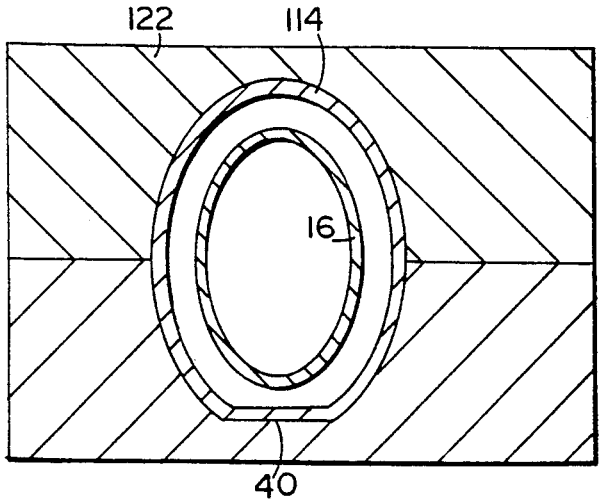
FIG. 7 is a sectional view through the hydroformed final product and die, taken on plane VII—VII of FIG. 6.
Figure 8:
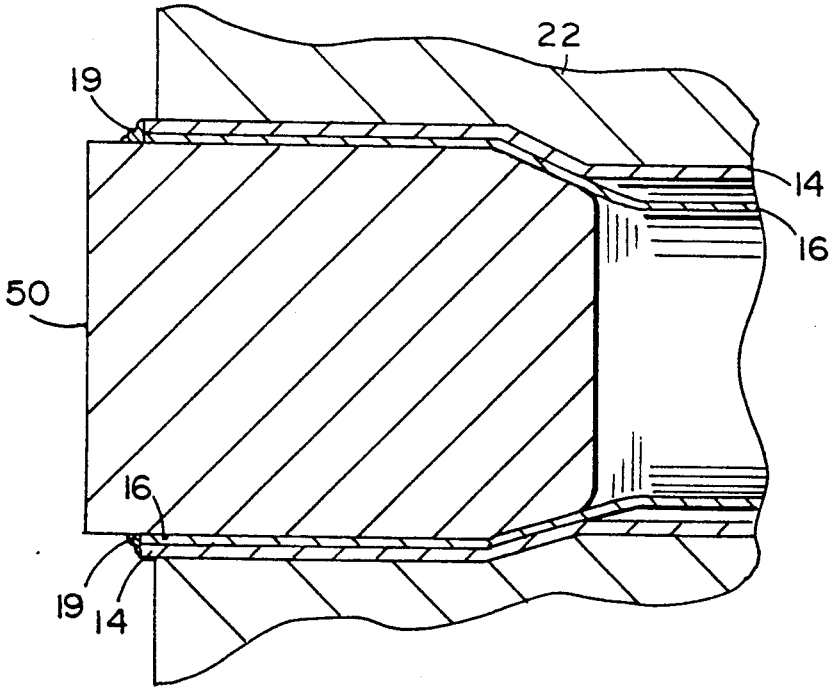
FIG. 8 is a fragmentary, enlarged sectional view of one end of the hydroforming die and the blank therein.

The specific location of the center line of preformed blank 112, and the periphery thereof, relative to the center line of the die cavity 20, is selected to cause the desired location of the ultimate inner membrane element 16 relative to the hydroformed expanded outer tube element 114 (FIG. 7). This is explained in more detail hereinafter. The two ends of the inner tube element are sealed to the two ends of the outer tube element. This can be achieved, for example, by welding the two together prior to placement in the die cavity as shown at weld 19 in FIG. 8., or by inserting and pressing a flared sealing mandrel member such as mandrel 52 in FIG. 9 within the inner tube en sufficiently to force such tightly out against the outer tube end. The flared segment 52*a* of mandrel 52 is preferably at an acute angle of about 20 degrees relative to the center line of the blank, as in the cooperative annular surface 22*a* of die 22, to tightly compress and seal the ends of the outer tube 14 by sealing the space between the tubes 14 and 16, thereby preventing fluid escape from the ends of the outer tube. One of the plugging mandrels, e.g., 52, has a passageway 54 from the exterior thereof to the interior of inner tube 16 to allow entry of pressurized liquid, preferably water, during operation of the hydroforming step to be described.

The preformed, bent blank 112, as placed in cavity 20, has inner component 16 basically of the same size, same wall thickness, same configuration and same location relative to the die cavity as in the final product. As to outer element 14, the initial blank thickness is greater than its final thickness, the size is substantially smaller than its final size, the configuration is simpler than its final configuration and its location is different from its final location relative to the die cavity and the inner tube. The exact position of inner tube 16 relative to outer tube 14 in the final product is determined by the location of the blank and its center line and periphery relative to the center line and periphery of die cavity 20. The center line and periphery of the inner membrane tube are basically the same for the final product as the initial blank, as noted above. The center line and periphery of the outer structural tube will change from being coincident to those of the inner tube in the blank, to those of the die cavity in the final product. The center line of the inner element can thus be made to be coincident with that of the outer element in the final product, or may be considerably offset therefrom.

After the inner tube is filled with hydroforming water, pressure is progressively increased on and by the water inside inner membrane tube 16. The fluid engages the inner surface of outer tube 14 through orifices 18 to start outer tube 14 expanding away from inner tube 16. As the pressure is applied to areas of the expanding outer tube 14 equally, further expansion causes portions of the outer tube to first engage the portions of the die cavity closest to the outer tube, e.g., protrusions 24, and successively engage other portions of die cavity 20 at greater and greater spacing from inner tube 16, until the entire surface area of die cavity 20 is completely engaged by the expanded outer member. The pressures required for achieving this substantial expansion of at least about twenty percent from a stainless steel outer tube of about 0.068 inch thickness have been found to be typically in the range of 900 to 1200 atmospheres, averaging about 1050 to 1100 atmospheres. The inner membrane tube has equal pressure on all faces so that it tends to float in its initial position within the hydraulic fluid during this hydroforming operation, changing little if at all. It is important to have an air gap extend over substantially the length of the component, such that the inner membrane tube engages the outer structural tube only at the ends thereof. Conceivably, the two tubes can sometimes have slight contact as at a substantial indentation such as 42 (FIG. 6), but this should be avoided or at least minimized, since this detracts significantly from the function of the product. It is possible to expand one portion of the duct, e.g., one end twenty, thirty or forty percent, while expanding other portions, e.g., the other end, very little if at all, if that is desired. Even though the air gap may be only a few thousandths of an inch, it has a tremendous effect on the results. If desired, it can vary from thousandths of an inch up to even one-half inch or more, over different portions of the structure, to achieve desired results and function. After hydroforming, portions at the ends of the component can be removed as offal, e.g., the area of the annular weld 19 in FIG. 8 or the annular flare 22*a* in FIG. 9. Further, an end portion of the outer tube can be cut off so that a segment of the inner tube extends therebeyond as for insertion into an adjoining exhaust duct component to which it is to be connected.

The final configuration of the outer tube element need not be, and normally is not, circular in cross section, or even necessarily oval in cross section, but can have varied cross sectional configurations over its length as needed. In the embodiment depicted, it is formed with three recesses 40 for shield brackets, one recess 42 for bypassing another tube (not shown), and two bends.

The preferred materials for the tubular elements, at least for the inner membrane tube, are stainless steel materials. These provide excellent lifetime characteristics at the high temperatures experienced by this structure. Conceivably the outer structural element can alternatively be made of high carbon steel. To be noted is that the metal employed for the outer tube component, in its annealed form prior to being formed into a tube and prior to other forming and bending operations, should have an expansion capability of at least about thirty percent, i.e., no less than about twenty seven percent.

The stainless steel alloys found most effective thus far are 304 SS and 409 SS. Other stainless steel alloys could be used, those set forth below being considered exemplary. The compositions of such stainless steel alloys are well known in the trade.

| Alloy | Composition |
|---|---|
| 304 SS | 18.5 Cr—9.5Ni |
| 409 SS | 11 Cr.3Ti |
| 439 SS | 17.3 Cr—.4Ti |
| 11 Cr—Cb SS | 11.2 Cr—1.3Si—.3Ti—.4Cb |
| 18 Cr—Cb SS | 18 Cr—.6Cb—.3Ti |
| 442 SS | 19.5 Cr—.5Cb—.5Cu |

Those persons skilled in this field will likely think of others which could be employed. It is desirable also to employ a conventional annealing step after the outer tube is formed from flat stock, and/or after significant additional forming and bending operations are performed on the blank, to minimize the potential for rupture of the outer tube during the hydroforming step.

In addition, variations in detail in the disclosed invention could be made to accommodate particular types of exhaust gas duct components, particular vehicle models, engine compartment dimensions, etc., such that the disclosed preferred embodiment herein is not intended to be limiting of the invention, which is to be limited only by the scope of the appended claims and the resonably equivalent structures and methods to those defined therein.

The embodiments of the invention in which an exclusive property or privilege is claimed are defined as follows:

1. A method of forming a tubular, double wall, air gap exhaust duct component for an internal combustion engine, comprising the steps of:

providing a thin walled, inner membrane duct element having a predetermined configuration, a plurality of spaced orifices through said wall along its length, and a pair of ends;

providing an imperforate outer structural duct element having an initial configuration generally matching that of said inner duct element configuration, and a pair of ends;

assembling said inner duct element inside said outer duct element to provide a dual wall blank;

sealing said inner duct ends to said outer duct ends to close off said outer duct ends, closing said inner duct ends with plugging mandrels, and placing and securing said blank in a hydroform die cavity having a confining wall of desired final configuration for said outer duct element of said duct component;

injecting a liquid into said inner duct element, and increasing the pressure on said liquid in a manner causing said liquid to flow through said orifices and expand said outer duct element ultimately into engagement with said die confining wall, while causing said inner duct element between its ends to retain essentially its initial size, location and configuration within said expanding outer element, to create an air gap between said elements over substantially the length thereof; and then releasing the pressure and draining said liquid from said duct elements.

2. The method of forming the air gap exhaust duct component in claim 1 wherein, before said injecting step, said outer duct element has an inner wall, said inner duct element has an outer wall, and said inner wall is in substantially 360 degree contact with said outer wall.

3. The method of forming the air gap exhaust duct component in claim 2 including at least one preforming or bending step creating at least one bend in said dual wall blank.

4. The method of forming the tubular, air gap exhaust duct component in claim 1 wherein said steps of providing said duct elements and assembling said duct elements occur generally simultaneously by rolling said inner element and said outer element together.

5. The method of forming the tubular, air gap exhaust duct component in claim 1 wherein said step of assembling comprises inserting said inner duct element into said outer duct element.

6. The method of forming the tubular, air gap exhaust duct component in claim 1 including the step of perforating said inner duct element wall to form said orifices.

7. The method of forming the tubular, air gap exhaust duct component in claim 6 wherein said perforating step is performed while said inner element wall is flat, prior to said inner duct element being formed.

8. The method of forming the tubular, air gap exhaust duct component in claim 1 wherein said outer duct element is placed in said die cavity in a manner to cause some portions of said outer duct element wall to be closer to said die cavity confining wall than other portions of said outer duct element;

said step of increasing the pressure including applying pressure to cause said some portions of said outer duct to engage said die cavity wall first, and then increasing the pressure further until said other portions fully engage said confining die cavity wall.

9. The method of claim 1 wherein said outer duct element is of a metal capable of at least about thirty percent expansion.

10. The method of claim 9 wherein said metal is a steel alloy.

11. The method of claim 1 wherein, before said injecting step said inner element has a wall thickness of about 0.028 inch or less, and said outer element has a wall thickness of at least about 0.020 inch or greater but in any event at least equal to or greater than said inner wall thickness.

12. The method of forming the air gap exhaust duct component in claim 1 including at least one preforming or bending step in portions of said blank, and wherein said outer duct element has an inner wall, said inner duct element has an outer wall, and said inner wall is in substantially 360 degree contact with said outer wall in at least said portions.

* * * * *